US009044665B2

(12) United States Patent
Haase et al.

(10) Patent No.: US 9,044,665 B2
(45) Date of Patent: Jun. 2, 2015

(54) TABLE BALL GAME FOR OPPOSITE ENDED PLAY USING A SINGLE BALL

(71) Applicants: Stuart Haase, Bloomington, MN (US); William J. Philipp, Bloomington, MN (US)

(72) Inventors: Stuart Haase, Bloomington, MN (US); William J. Philipp, Bloomington, MN (US)

( * ) Notice: Subject to any disclaimer, the term of this patent is extended or adjusted under 35 U.S.C. 154(b) by 51 days.

(21) Appl. No.: 13/815,041

(22) Filed: Jan. 25, 2013

(65) Prior Publication Data

US 2014/0213380 A1 Jul. 31, 2014

(51) Int. Cl.

| | |
|---|---|
| ***A63F 7/00*** | (2006.01) |
| ***A63D 15/04*** | (2006.01) |
| *A63F 7/34* | (2006.01) |

(52) U.S. Cl.

CPC ..... *A63D 15/04* (2013.01); *A63F 7/0017* (2013.01); *A63F 7/0005* (2013.01); *A63F 2007/345* (2013.01)

(58) Field of Classification Search

CPC ... A63F 7/0017; A63F 7/0047; A63F 7/0005; A63F 2007/345

USPC ..... 273/115, 116, 118 R, 123 R, 124 R, 273/125 R, 125 A, 309; 473/3, 4, 10, 12, 14, 473/17–20, 22, 28, 29, 157

See application file for complete search history.

(56) References Cited

U.S. PATENT DOCUMENTS

| | | | | |
|---|---|---|---|---|
| 1,089,278 | A * | 3/1914 | Shipman | 273/115 |
| 4,095,793 | A | 6/1978 | Ray | |
| D357,283 | S | 4/1995 | Maxwell | |
| 5,865,681 | A | 2/1999 | Tudek et al. | |
| 5,988,636 | A | 11/1999 | Kilmer | |
| 6,168,533 | B1 | 1/2001 | Camara | |
| 6,375,191 | B1 * | 4/2002 | Heggie | 273/309 |
| 2005/0101396 | A1 * | 5/2005 | Chevillotte | 473/4 |
| 2006/0226606 | A1 * | 10/2006 | Finley et al. | 273/342 |
| 2009/0270191 | A1 * | 10/2009 | Cartwright | 473/33 |

* cited by examiner

*Primary Examiner* — Benjamin Layno

(57) ABSTRACT

A table ball game in which is provided a flat rigid playing surface of rectangular proportions. The playing surface is bounded by rails of sufficient height to prevent a ball from leaving the playing surface. There is a plurality of object holes located symmetrically at opposite ends of the longitudinal axis of the playing surface. A pair of lines are inscribed across the transverse axis near the object holes to denote a foul line for both the rolling of a ball and the rebounding of a rolled ball. For scoring purposes, the object holes are assigned numeric values in accordance with rules of play.

3 Claims, 3 Drawing Sheets

TABLE BALL GAME FOR OPPOSITE ENDED PLAY USING A SINGLE BALL

CROSS-REFERENCE TO RELATED APPLICATIONS

None.

FEDERALLY SPONSORED RESEARCH

None.

SEQUENCE LISTING

None.

TECHNICAL FIELD

This invention relates generally to amusement devices. More specifically, this invention concerns a table ball game.

BACKGROUND

In the amusement industry, many table style games are available. Most notable among these are pool or billiards, shuffleboard, air hockey, and foosball. Although these are currently in widespread use, there are features of each device which present limitations as to where they may be used, cause ongoing maintenance and expense, and potentially reduce the enjoyment of the games, particularly with novices.

The primary drawback to pool or billiard tables is the excessive amount of free space required around the table to facilitate proper play, thereby making it impractical for use in smaller establishments or private homes. Additionally, a great number of accessories are required in the form of balls, cue sticks, chalk, etc., which along with the playing surface itself eventually become worn or damaged, thus requiring expensive replacement. Bumper pool tables, being somewhat smaller, require somewhat less free space but are still subject to the same accessory, wear and maintenance issues.

Similarly, shuffleboard tables are limited in their placement options because of their extreme length. Other drawbacks include the need for frequent cleaning and rewaxing of the playing surface, which eventually wears with use, thereby requiring tedious refinishing.

Table games such as air hockey and foosball may be placed in more restricted locations; however, these devices have features which may be seen as undesirable. Air hockey, for instance, requires an electrically driven blower to pressurize the playing surface, thereby requiring a conveniently placed power source. The blower mechanism adds complexity and cost to manufacture, and is prone to failure, requiring expensive repair or replacement. Foosball games also present an increased complexity and cost in manufacture, due to the number of shafts, bushings, composite "players," and handles, which additionally will wear or break, requiring costly replacement.

To be competitive in all of the aforementioned games, a set of skills must be developed through an investment in time and practice. This could be greatly discouraging to a novice or occasional player who would be at a great disadvantage against a more skilled opponent. Additionally, the speed of games such as air hockey and foosball can be very daunting.

Attempts are made to create new games which may overcome some of these issues. U.S. Pat. Nos. 6,168,533 to Camara, D357,283 to Maxwell, 4,095,793 to Ray, and 5,988,636 to Kilmer all depict games which are more compact or portable, requiring less space and are much simpler in manufacture. However, these games are all basically cue variations or golf-based variations on other established games, having much the same objectives and many of the same issues with accessories and potential replacement. An exception would be U.S. Pat. No. 5,865,681 to Tudek et al., which shows a game with a convertible design, few accessories, and embodies different scoring objectives but is once again a golf variation and also limited in placement by its extreme length.

Given the above limitations and owing also to the fact that game enthusiasts are always seeking new and unusual challenges, a need therefore exists for a new game with a more space efficient design having a no-maintenance playing surface, a single easily replaceable ball, a unique set of scoring objectives, and no polished skills required to begin enjoying the game. It also desirable that this game would require no additional accessories, no electrical power, no mechanisms, and would need no costly maintenance, repair, or replacement.

SUMMARY

This present invention comprises a table ball game which overcomes the foregoing and other difficulties associated with the prior art. In accordance with the invention, there is provided a flat rigid playing surface of rectangular proportions. The playing surface is bounded by rails of sufficient height to prevent a ball from leaving the playing surface. There is a plurality of object holes located symmetrically at opposite ends of the longitudinal axis of the playing surface. A pair of lines are inscribed across the transverse axis near the object holes to denote a foul line, both for the rolling of the ball and rebounding of a rolled ball.

In a first embodiment, the playing surface member is mounted in an enclosure which provides a means for affixing the boundary rails, provides a means for returning balls which have dropped through the object holes to a conveniently reached return area, and is elevated on legs having leveling devices, thereby raising the playing surface to a comfortable height and providing means to level the game.

In a second embodiment, the playing surface member is securely affixed to a subsurface of sufficient rigidity to prevent warping or twisting of the playing surface. The object holes are drilled only through the playing surface but not through the subsurface, thereby providing a recess to catch and contain the ball as it drops into the hole. The entire structure is bounded by rails to keep the ball contained within the playing field. This embodiment provides for portability and ease of storage, and may be used on the ground or floor or placed upon a table or other structure of sufficient strength to accommodate it. The game may be leveled using any convenient shimming means.

REFERENCE NUMERALS

Figure 1:
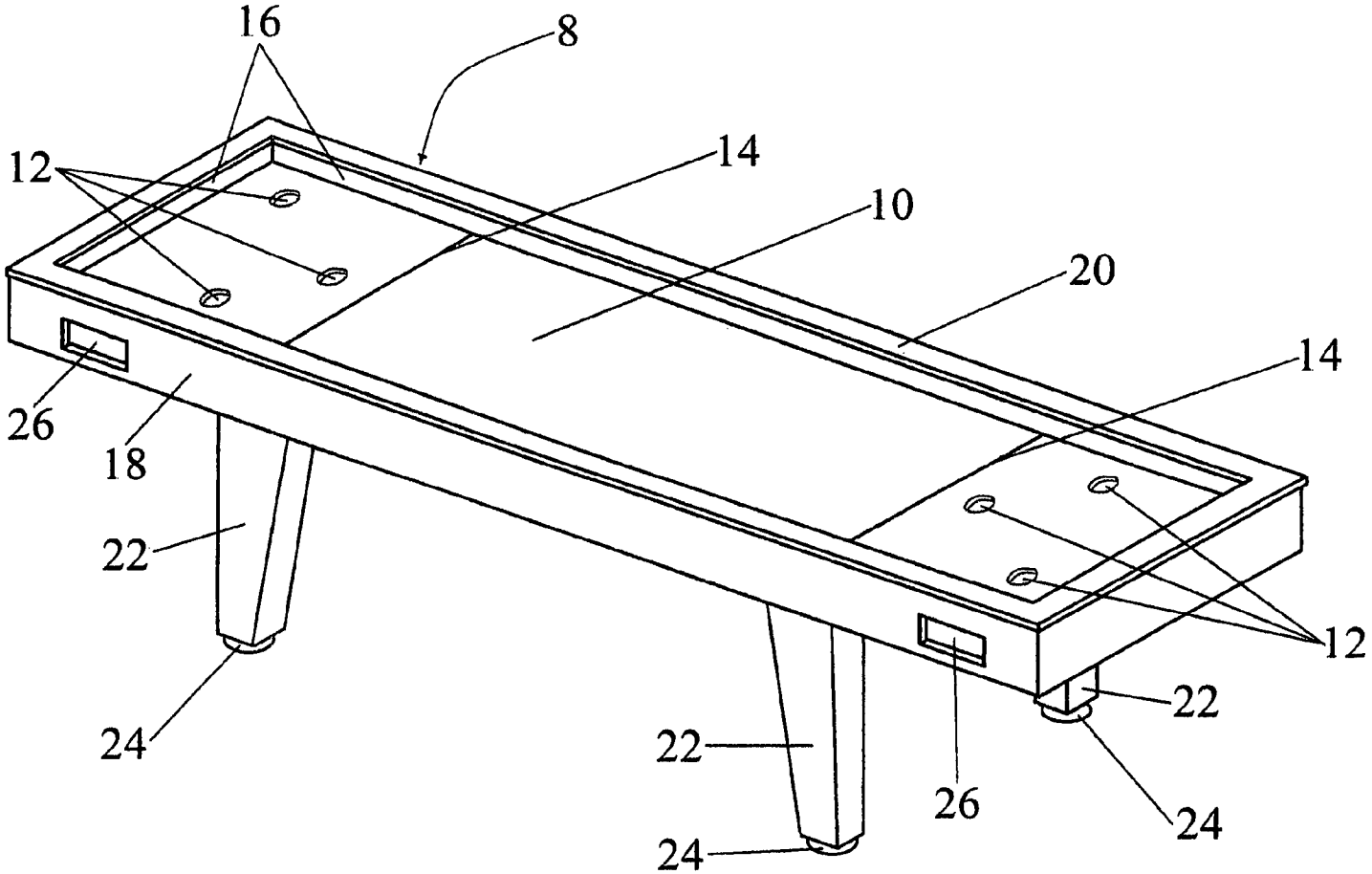
FIG. 1 is an overall perspective view of a first embodiment of the invention.
Figure 2:
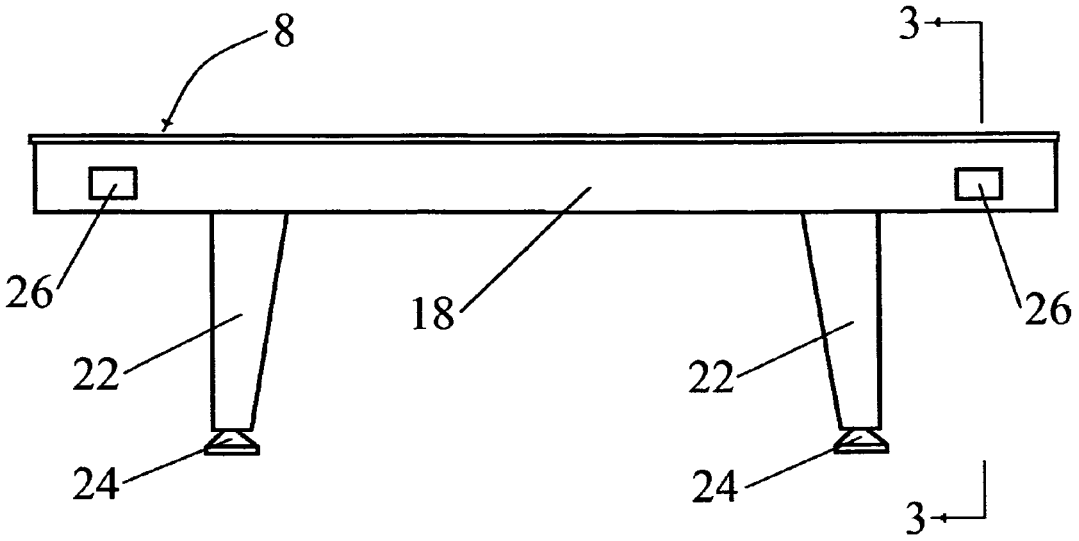
FIG. 2 is a side view thereof.

8 table ball game
10 playing surface member

12 object holes
14 foul line
16 rails
18 enclosure
20 trim
22 legs
24 levelers
26 ball return openings
28 ball return ramp
30 cross member
32 subsurface member

DETAILED DESCRIPTION

Referring now to the drawings, wherein like reference numerals designate like or corresponding elements throughout the views, and particularly referring to FIG. 1, there is shown an embodiment of the table ball game 8.

The table ball game 8 is comprised of a playing surface member 10 securely mounted in an enclosure 18. The playing surface member 10 may be made from any material which would give it sufficient strength, rigidity, and durability, such as plywood, fiberboard, plastics, or other composites. The playing surface member 10 is bounded by rails 16 which are secured to the inside upper edges of enclosure 18. The top edges of rails 16 and enclosure 18 is bounded for appearance and comfort by trim 20. The enclosure 18 is mounted on legs 22, each of which is fitted at its bottom with an adjustable leveler 24.

Object holes 12 are arranged in a symmetrical fashion at opposite ends of the playing surface member 10. Located a predetermined distance from the object holes 12 at either end of the playing surface member 10 are transverse markings which denote foul lines 14.

Figure 3:
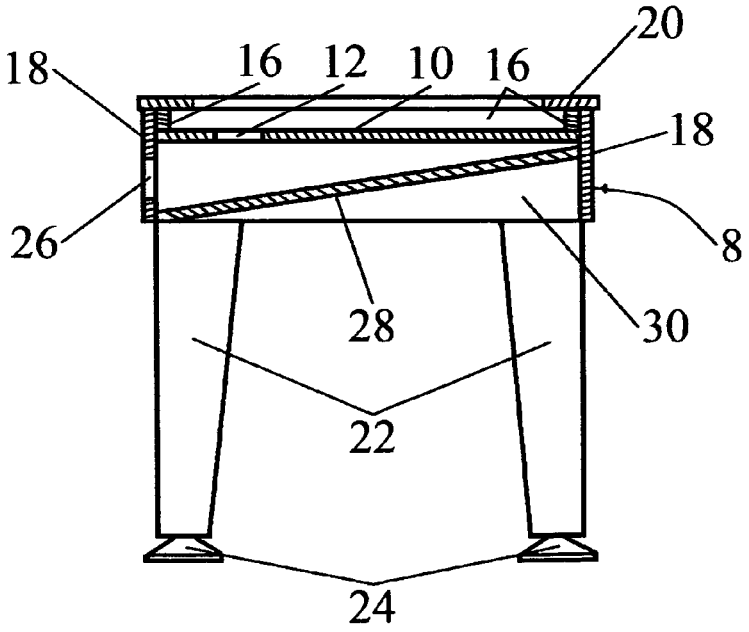
FIG. 3 is a sectional view taken along the lines 3-3 of FIG. 2 in the direction of the arrows.

Referring now to FIG. 3, there is shown a sectional view of the enclosure 18. Shown is a cross member 30 one of a plurality of which are mounted in a transverse fashion in the enclosure 18 to support the playing surface member 10 and provide mounting means for legs 22. Also shown is a ball return ramp 28 which provides a means for directing a ball which has dropped through an object hole 12 to the ball return opening 26 to be conveniently retrieved by the player. Other ball return means may be used such as individual chutes or a tubular apparatus.

Figure 4:
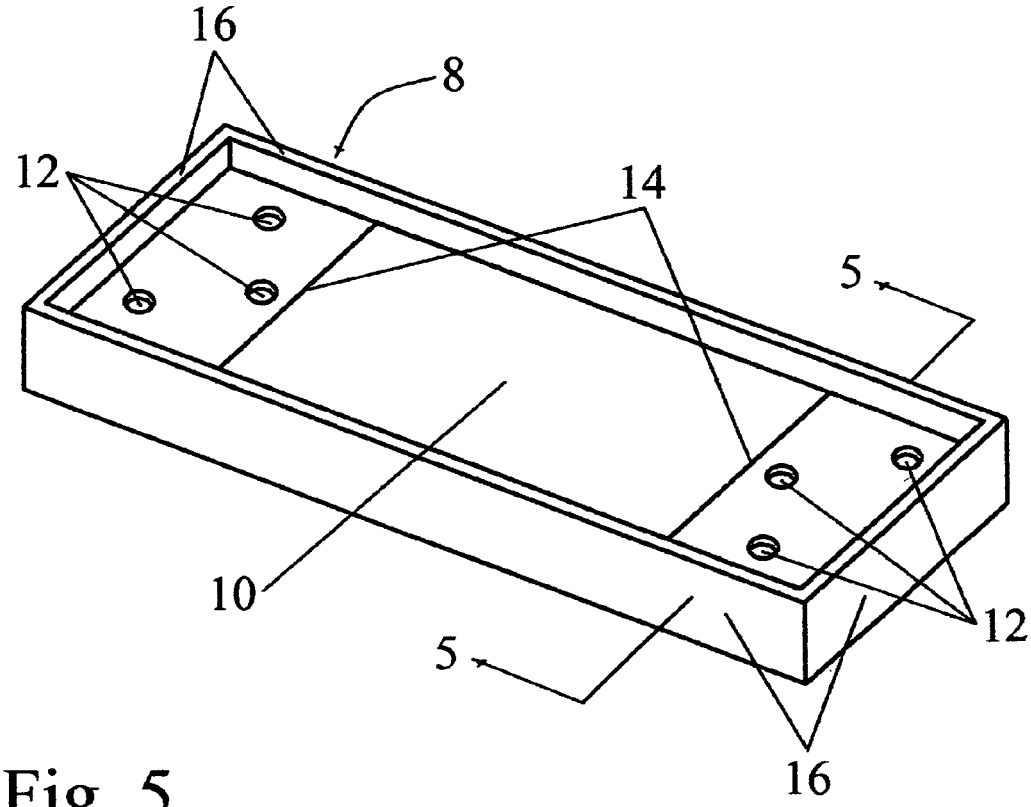
FIG. 4 is an overall perspective view of a second embodiment of the invention.
Figure 5:
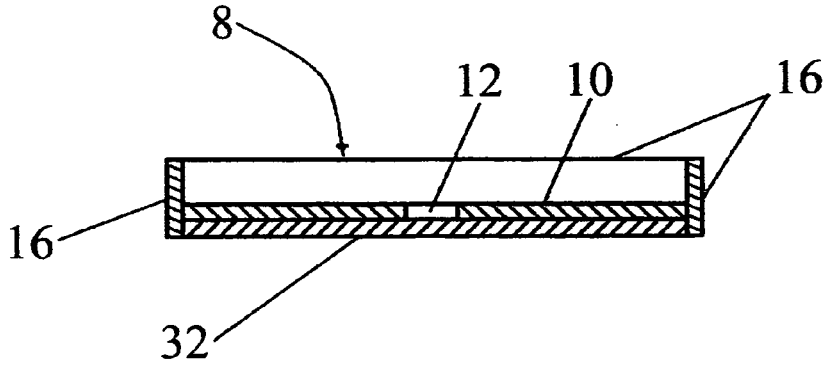
FIG. 5 is a sectional view taken along the lines 5-5 of FIG. 4 in the direction of the arrows.

Referring now to FIG. 4, there is shown a second embodiment of the invention which depicts a simplified version of the table ball game 8. Again, there is an elongated playing surface member 10 featuring a plurality of object holes 12 arranged symmetrically at opposite ends with transverse markings to denote foul lines 14. Referring now to FIG. 5, there is shown a subsurface member 32 to which the playing surface member 10 is affixed. The object holes 12 extend only through the playing surface member 10 but not through the subsurface member 32 thereby providing a means to catch and contain the ball. The playing surface member 10 and subsurface member 32 are bounded by rails 16. These and other possible embodiments may include variations not depicted such as fitment of apparatus to provide for automatic scoring.

The preferred configuration of the invention is one in which the playing surface is rectangular with a length approximately four times its width. The playing surface is hard and smooth. There are three object holes at each end set in a staggered fashion behind the foul line which would be located approximately one-fifth the length of the playing surface from each end. The object holes would be assigned numeric values 1, 2, and 3, and a color value such as red and blue for scoring purposes. The preferred ball would be a standard golf ball, the dimples of which would cause it to roll in a slightly erratic fashion as its movement slows, thereby adding an increased challenge factor.

Having described the table ball game in detail and particularly the preferred configuration, a typical game might be played as set forth herein.

Two individual players or teams of two or more players will compete and must decide who will score as red or blue. A winning score must be established usually an odd number such as 11, 17, or 21. The general playing rules require a determination of which player will start the game. This may be accomplished by a coin toss or any other agreed upon method.

Each player is positioned at ends opposite their chosen color. Each player then takes a turn at rolling the ball toward the object holes at the opposite end of the playing surface in an attempt to score. The ball must be released from behind the foul line nearest the player taking their turn. The ball remains in play until one of the following conditions is met:

a. The ball drops into an object hole in which case the appropriate point value is tallied.
b. The ball rebounds and rolls back across the foul line nearest the object holes.
c. The ball comes to a stop on the playing surface behind the foul line.

At this point the opposing player may retrieve the ball and take their turn. The game continues in this manner until one of the players reaches the established point value. The winning point value must be reached by an exact score and not be an overscore. For example, if the winning point value is 11 points and the player has 10 points, only the 1-point object hole will be counted. If the ball drops into the 2-point or 3-point hole, the player's score will remain at 10 and the opposing player will get a turn. In this way a greater challenge factor will be established. This represents merely one set of rules and as will be seen many other games are possible on this device.

Although particular embodiments of the invention have been illustrated in the accompanying Drawings and described in the foregoing Detailed Description, it will be understood that the invention is not limited only to the embodiments disclosed but is intended to embrace any alternatives, equivalents, and/or modifications which fall within the scope of the invention as defined by the Claims.

What is claimed is:

1. A table ball game comprising:

an elongated rigid smooth hard unobstructed playing surface having a longitudinal axis said playing surface having consisting of only three object holes at opposite ends of the longitudinal axis of the playing surface said playing surface being bound at its outer perimeter by a plurality of rigid hard rails said object holes being spaced inwardly from said rails said object holes at one end of the longitudinal axis of the playing surface being arranged in a predetermined asymmetric grouping said grouping of object holes also being located symmetrically at the opposite end of the longitudinal axis of the playing surface said playing surface being securely mounted in an enclosure to which are affixed a plurality of legs said playing surface having a single line perpendicular to the longitudinal axis at a predetermined distance forwardly from said object holes at either end of the longitudinal axis.

2. The table ball game of claim 1 wherein said enclosure provides an internal means for returning a ball which has dropped through one of said object holes in said playing surface to an area which is located near the corresponding end of the longitudinal axis of the enclosure.

3. A table ball game comprising:

a relatively thick elongated rigid smooth hard unobstructed playing surface having a longitudinal axis said playing surface having consisting of only three object holes at opposite ends of the longitudinal axis of the playing surface said playing surface being affixed to a relatively thick rigid subsurface said playing surface and said subsurface being enclosed at its outer perimeter by a plurality of rigid rails which add structural stability to said playing surface and said subsurface said object holes being spaced inwardly from said rigid rails said object holes at one end of the longitudinal axis of the playing surface being arranged in a predetermined asymmetric grouping said grouping of object holes also being located symmetrically at the opposite end of the longitudinal axis of the playing surface said playing surface having a single line perpendicular to the longitudinal axis at a predetermined distance forwardly from said object holes at either end of the longitudinal axis.

* * * * *